US011304280B2

(12) United States Patent
Huang et al.

(10) Patent No.: US 11,304,280 B2
(45) Date of Patent: Apr. 12, 2022

(54) DRIVE CIRCUIT FOR FLICKER-FREE LED LIGHTING HAVING HIGH POWER FACTOR

(71) Applicant: SUZHOU REGU. TECHNOLOGY INC., Jiangsu (CN)

(72) Inventors: Shengming Huang, Suzhou (CN); Duoli Feng, Suzhou (CN); Tao Huang, Suzhou (CN); Tian Guo, Suzhou (CN); Weidong Li, Suzhou (CN)

(73) Assignee: SUZHOU REGU. TECHNOLOGY INC., Jiangsu (CN)

( * ) Notice: Subject to any disclaimer, the term of this patent is extended or adjusted under 35 U.S.C. 154(b) by 0 days.

(21) Appl. No.: 17/275,138

(22) PCT Filed: Aug. 15, 2019

(86) PCT No.: PCT/CN2019/100783

§ 371 (c)(1),
(2) Date: Mar. 10, 2021

(87) PCT Pub. No.: WO2020/052404

PCT Pub. Date: Mar. 19, 2020

(65) Prior Publication Data

US 2021/0345465 A1 Nov. 4, 2021

(30) Foreign Application Priority Data

Sep. 14, 2018 (CN) ..... 201811071542.2

(51) Int. Cl.
*H05B 45/382* (2020.01)
*H05B 45/355* (2020.01)
(Continued)

(52) U.S. Cl.
CPC ..... *H05B 45/382* (2020.01); *H05B 45/355* (2020.01)

(58) Field of Classification Search
CPC ..... H05B 45/382; H05B 45/385; H05B 45/3725; H05B 45/39; H05B 45/10;
(Continued)

(56) References Cited

U.S. PATENT DOCUMENTS

2011/0292693 A1 12/2011 Niijima et al.
2012/0025735 A1 2/2012 Wang et al.
(Continued)

FOREIGN PATENT DOCUMENTS

CN 104218806 12/2014
CN 204119610 U 1/2015
(Continued)

OTHER PUBLICATIONS

International Search Report issued for International Patent Application No. PCT/CN2019/100783, dated Nov. 15, 2019, 7 pages including English translation.

*Primary Examiner* — Wei (Victor) Y Chan
(74) *Attorney, Agent, or Firm* — Hamre, Schumann, Mueller & Larson, P.C.

(57) ABSTRACT

A drive circuit for flicker-free LED lighting having a high power factor, the circuit comprising a start-up circuit, a controller, a transformer T1, a first current switch, and a second current switch. The transformer T1 comprises a main primary winding Np1, a primary winding Np2, a primary winding Na, and a secondary winding Ns. The main primary winding Np1 and the primary winding Np2 are in-phase, the primary winding Na and the secondary winding Ns are in-phase, and phases of the main primary winding Np1 and the secondary winding Ns are inverted. The start-up circuit and the transformer T1 are connected to an input terminal Vin. The start-up circuit, the first current switch, and the second current switch are connected to the controller. The controller controls, by means of controlling the first current switch, and the second current switch to turn on or off, an
(Continued)

output current of the secondary winding Ns of the transformer T1. The drive power supply circuit for LED lighting having a high power factor reduces ripples in an output current, thereby realizing advantages of a high power factor, being flicker-free, and having a low cost, etc., for LED lighting.

6 Claims, 6 Drawing Sheets

(51) Int. Cl.
*H05B 45/3725* (2020.01)
*H05B 45/39* (2020.01)

(58) Field of Classification Search
CPC ..... H05B 45/375; H05B 45/38; H05B 45/37; H05B 45/46; H05B 45/00
See application file for complete search history.

(56) References Cited

U.S. PATENT DOCUMENTS

| | | | | |
|---|---|---|---|---|
| 2012/0153866 | A1* | 6/2012 | Liu | H02M 3/33561 315/294 |
| 2012/0200229 | A1* | 8/2012 | Kunst | H05B 45/3577 315/186 |
| 2013/0343095 | A1 | 12/2013 | Zhu et al. | |
| 2017/0027029 | A1 | 1/2017 | Hu et al. | |

FOREIGN PATENT DOCUMENTS

| | | |
|---|---|---|
| CN | 105007666 | 10/2015 |
| CN | 105873299 | 8/2016 |
| CN | 205847120 U | 12/2016 |
| CN | 109862653 | 6/2019 |
| JP | H07203678 | 8/1995 |

* cited by examiner

DRIVE CIRCUIT FOR FLICKER-FREE LED LIGHTING HAVING HIGH POWER FACTOR

CROSS REFERENCES TO RELATED APPLICATION

This patent application claims priority to Chinese patent application No. 2018110715422, filed on Sep. 14, 2018, entitled "LIGHTING DRIVE CIRCUIT FOR LED HAVING HIGH POWER FACTOR" the disclosure of which is hereby incorporated by reference in its entirety.

TECHNICAL FIELD

The present disclosure relates to a drive circuit for high power factor stroboscopic-free LED lighting.

BACKGROUND

Due to energy-saving characteristics of light-emitting diode (LED) lights, an energy consumption index (conversion efficiency and power factor) of a high-voltage alternating current (AC)/direct current (DC) conversion LED lighting drive power supply itself becomes a key factor of energy-saving of the whole lighting system. Power factor (PF value) is an important performance indicator for the LED lighting. The Energy Star standard states that for LED lighting products greater than 5 W, the power factor index, i.e., PF value, must be greater than 0.7. For LED lighting applications more than 10 watts, the PF value shall be greater than 0.9. The PF value of LED lighting drive power supply can be increased to more than 0.9 by a control method of an active or a passive power factor adjustment (PFC). Moreover, an active adjusting method is more effective, which uses a controller to directly implement a high PF value. Due to safety requirements, the LED lighting drive power supply generally adopts a transformer to implement an electrical isolating type topology. For lighting markets below 30 watts to 70 watts, a single-stage topology based on primary side or secondary side feedback control of the transformer is often used to reduce costs of the drive power supply. The single-stage primary side feedback topology (PSR) based on the transformer has advantages of simple structure, few components and low cost, and thus has been widely used in occasions where the output power is less than 30 watts to 70 watts, especially in the low-end lighting market.

SUMMARY

An object of the present disclosure is to provide a drive circuit for high power factor stroboscopic-free LED lighting.

For this purpose, the technical solutions of the present disclosure are as follows.

A drive circuit for high power factor stroboscopic-free LED lighting includes a start-up circuit, a controller, a transformer T1, a first current switch and a second current switch. The transformer T1 includes a primary main winding Np1, a primary winding Np2, a primary winding Np2 and a secondary winding Ns. The primary main winding Np1 and the primary winding Np2 are in phase. The primary winding Na and the secondary winding Ns are in phase. The primary main winding Np1 and the secondary winding Ns are in opposite phase. The start-up circuit and the transformer T1 are connected to an input terminal Vin. The start-up circuit, the first current switch, and the second current switch are connected to the controller. The controller controls current output of the secondary winding Ns of the transformer T1 by controlling switch-on and switch-off of the first current switch, and the second current switch.

The details of one or more implementations of the subject matter described in this specification are set forth in the accompanying drawings and the description below. Other potential features, aspects, and advantages of the subject matter will become apparent from the description, the drawings, and the claims.

BRIEF DESCRIPTION OF THE DRAWINGS

The following drawings of the present disclosure are used herein as part of the present disclosure to understand the present disclosure. Embodiments of the present disclosure and description thereof are illustrated in the accompanying drawings to explain the principle of the present disclosure FIG. 1(*a*) is a view showing waveforms of currents of primary and secondary windings of a transformer in a conventional single-stage topology high power factor LED lighting drive power supply.

FIG. 3(*b*) is a view showing waveforms of the two-phase currents generated after the controller is turned on, in different switching periods in FIG. 2.

FIG. 5(*b*) is a schematic view showing waveforms of the two-phase output currents of a secondary side of the transformer and the total output current generated after superposition in a half power frequency cycle after the controller is turned on in FIG. 2.

DETAILED DESCRIPTION OF THE EMBODIMENTS

Figure 1A:
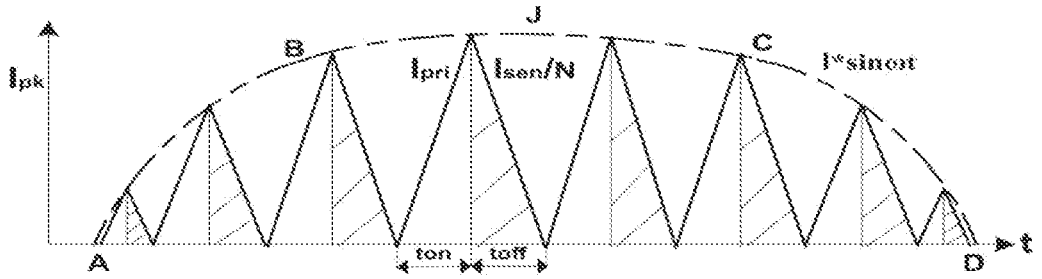
FIG. 1(*b*) is a view showing a waveform of a current of a power supply output LED corresponding to FIG. 1(*a*).
Figure 1B:
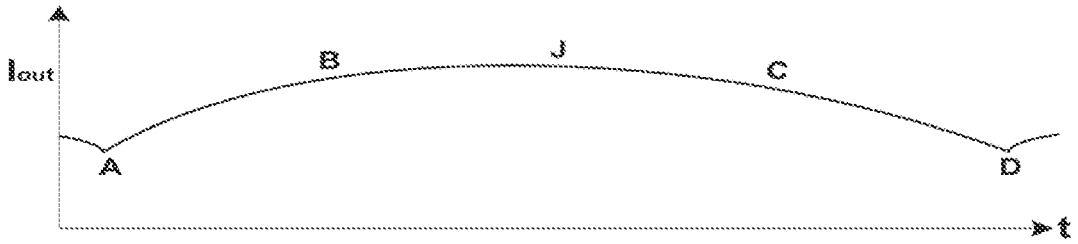

For the high power factor single-stage topology drive power supply based on the transformer, regardless of whether the secondary side feedback or the primary side feedback control method is used, there is a sinusoidal half-wave fluctuation of the output current at twice the power frequency in the application, which causes an stroboscopic problem of the LED lighting brightness, resulting in a certain percentage (about 10%) of people will have adverse reactions in an stroboscopic environment, and thus which will be restricted in the high-end lighting market. FIG. 1(*a*) shows waveforms of currents of the primary and secondary windings of a transformer in a conventional high power factor single-stage topology LED lighting drive power supply operating in current critical mode, in a half power frequency cycle, that is, a sinusoidal half-wave. FIG.

1(*b*) shows waveforms of a current of a power supply output of the LED corresponding to an input of FIG. 1(*a*). In FIG. 1(*a*), Ipri denotes a rising current of the primary winding in a switch-on time ton after a primary side control switch of the transformer is turned on, Isen denotes a falling current of the secondary winding in a switch-off time toff after the primary side control switch of the transformer is turned off, and N denotes a turn ratio of the primary winding and the secondary winding of the transformer. A relation between a primary peak current Ipri_pk and a secondary peak current Isen_pk in each switching period is that:

$$Ipri_pk = Isen_pk/N \quad (1)$$

Due to characteristics of the high power factor, the primary peak current Ipri_pk and the secondary peak current Isen_pk/N exhibit a sinusoidal half-wave waveform as shown in FIG. 1(*a*), in which a hatched area portion is the output current. Therefore, the output current will exhibit the sinusoidal fluctuation as shown in FIG. 1(*b*).

Generally, there are three solutions to this problem, but all of them require two-stage topologies, and the three solutions are respectively:

Solution 1: a primary side PFC+PSR, that is, a power factor adjustment of the first stage. The input voltage of the sinusoidal half-wave with high power factor is increased to 400 volts, and output energy of the first stage is stored with a capacitor with larger capacitance. Then, a single-stage primary side feedback topology is used to construct the second stage.

Solution 2: a constant current control of the primary side PSR+ the secondary side DC/DC.

Solution 3: a peak current absorption of the primary side PSR+ the secondary side.

Either of the above solutions will increase the cost and volume of the power supply, and the conversion efficiency will decrease due to the application of the two-stage topologies, especially for the Solution 3.

The present disclosure is further described below in conjunction with the attached drawings and specific embodiments, but the following embodiments do not limit the disclosure in any way.

Figure 2:
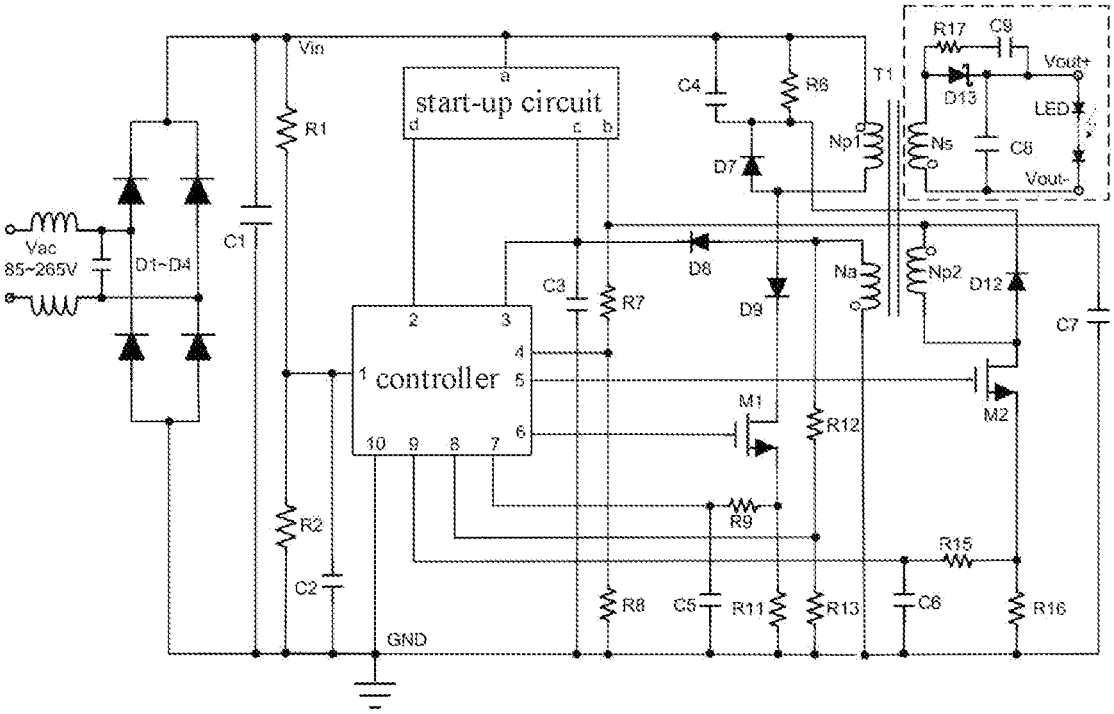
FIG. 2 is a schematic view of a first circuit of a drive circuit for high power factor stroboscopic-free LED lighting according to the present disclosure.
Figure 6:
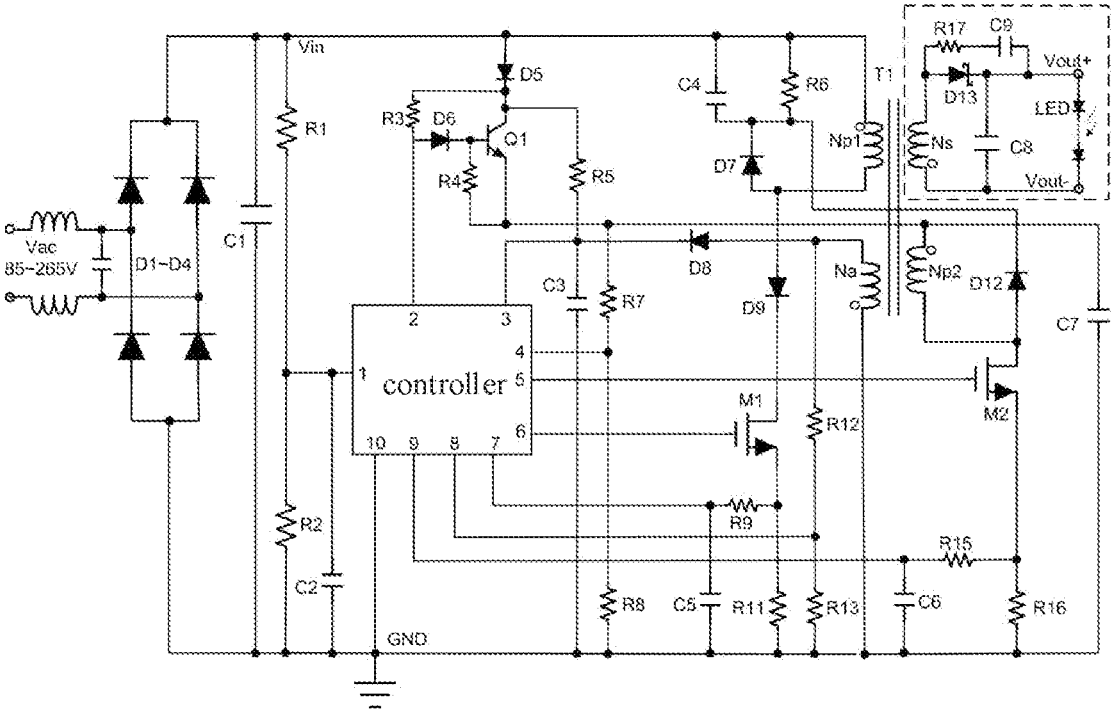
FIG. 6 is a schematic view of a second circuit of a drive circuit for high power factor stroboscopic-free LED lighting according to the present disclosure.
Figure 7:
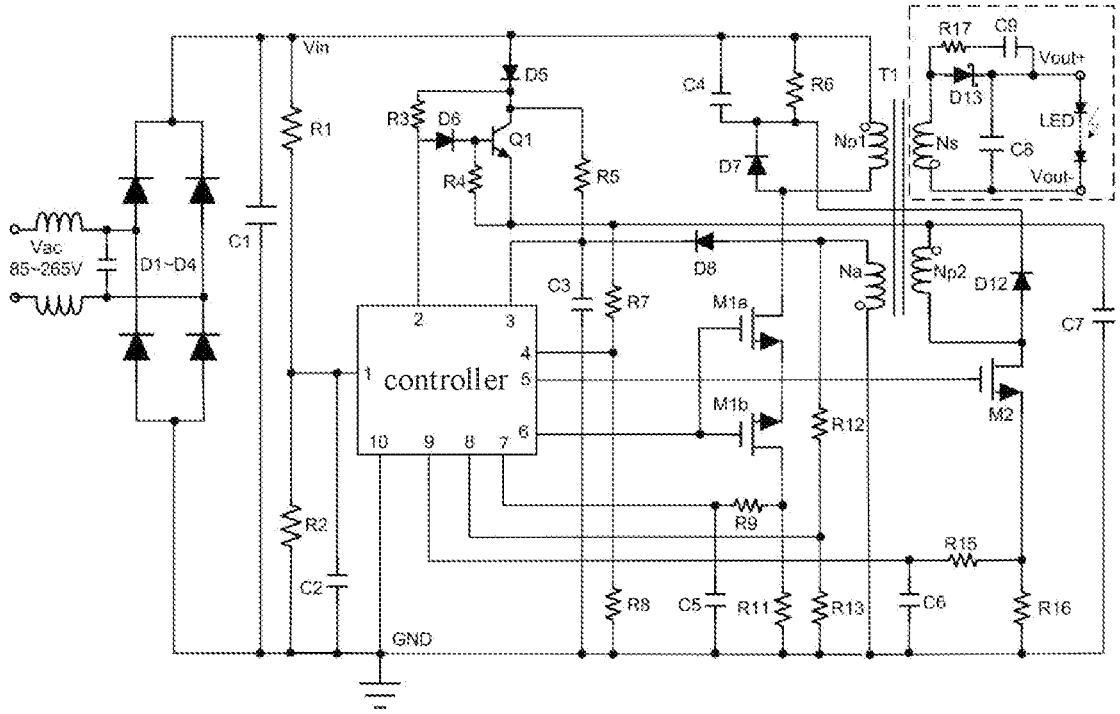
FIG. 7 is a schematic view of a third circuit of a drive circuit for high power factor stroboscopic-free LED lighting according to the present disclosure.

The description of pins in FIG. 2, FIG. 6, and FIG. 7:

Controller: input voltage monitoring input terminal 1, precharge completion feedback output terminal 2, power supply input terminal 3, first drive output terminal 6, second drive output terminal 5, first phase transmission current monitoring input terminal 7, transformer secondary winding current and output overvoltage monitoring input terminal 8, second phase transmission current monitoring input terminal 9, and ground terminal 10;

Start-up circuit: high voltage input terminal a, precharge output terminal b, precharge output terminal c, and feedback input, terminal d;

For simplicity of description, the pin number of the chip is directly quoted when an operating principle is introduced.

Embodiment 1: as shown in FIG. 2, a drive circuit for high power factor stroboscopic-free LED lighting includes a start-up circuit, a controller, a transformer T1, a first current switch and a second current switch. The transformer T1 includes a primary main winding Np1, a primary winding Np2, a primary winding Na and a secondary winding Ns. The primary main winding Np1 and the primary winding Np2 are in phase. The primary winding Na and the secondary winding Ns are in phase. The primary main winding Np1 and the secondary winding Ns are in opposite phase. The start-up circuit and the transformer T1 are connected to an input terminal Vin. The start-up circuit, the first current switch, and the second current switch are connected to the controller. The controller controls current output of the secondary winding Ns of the transformer T1 by controlling switch-on and switch-off of the first current switch, and the second current switch. A circuit access point after full-bridge rectification of external AC is the input terminal Vin, assuming that the voltage at this point is Vin.

The drive power supply circuit further includes capacitors C1 to C9, resistors R1 to R2, resistors R6 to R9, resistors R11 to R13, resistors R15 to R17, diode D7 to D8, and diodes D12 to D13.

The input voltage monitoring input terminal 1 of the controller is grounded via the resistor R2. The capacitor C2 is arranged in parallel at both ends of the resistor R2. The input terminal Vin is connected to the input voltage monitoring input terminal 1 of the controller via the resistor R1. The capacitor C1 is disposed between the input terminal Vin and ground. The high voltage input terminal a of the start-up circuit is connected to the input terminal Vin. The feedback input terminal d of the start-up circuit is connected to the precharge completion feedback output terminal 2 of the controller. The precharge output terminal c of the start-up circuit is connected to one end of the capacitor C3, and the other end of the capacitor C3 is grounded. The precharge output terminal b of the start-up circuit is connected to the resistor R7 and an energy storage capacitor C7 simultaneously, and is grounded via the resistor R7 and the resistor R8 in turn. An intersection point of the resistor R7 and the resistor R8 is connected to the voltage monitoring input terminal 4 of the controller for the capacitor C7. The first phase transmission current monitoring input terminal 7 of the controller is connected to a current output terminal of a first control switch via the resistor R9. The second phase transmission current monitoring input terminal 9 of the controller is connected to a current output terminal of a second control switch via the resistor R15. The transformer secondary current and output overvoltage monitoring input terminal 8 of the controller is grounded via the resistor R13, and connected to an anode of the diode D8 via the resistor R12; The energy storage capacitor C7 is used to store energy required by the second phase transmission current.

A positive electrode of the primary main winding Np1 is connected to the input terminal Vin. A negative electrode of the primary main winding Np1 is returned to the positive electrode via the diode 7 and the resistor R6 in turn, to form a closed circuit. The capacitor C4 is connected in parallel at both ends of the resistor R6. A positive electrode of the diode D7 is grounded via the first current switch and the resistor R11 in turn. A control terminal of the first current switch is connected to the first drive output terminal 6 of the controller. A negative electrode of the diode D7 is connected to a negative electrode of the diode D12. A positive electrode of the diode D12 is grounded via the second current switch and the resistor R16 in turn. A control terminal of the second current switch is connected to the second drive output terminal 5 of the controller. A positive electrode of the primary winding Na is grounded, the negative electrode thereof is connected to the resistor R12 and connected to the precharge output terminal c of the start-up circuit and the power supply input terminal 3 of the controller simultaneously via the diode D8. A positive electrode of the primary winding Np2 is connected to the precharge output terminal b of the start-up circuit, and is returned to a negative electrode of the primary winding Np2 via the capacitor C7, the resistor R16, and the second current switch in turn simultaneously, to form a circuit. Both ends of the secondary winding Ns pass through the diode D13 to a power output terminal and are connected to the LED lights.

Embodiment 2

A difference from Embodiment 1 is that, the start-up circuit includes a triode Q1, diodes D5 to D6, and resistors R3 to R5. A positive electrode of the diode D5 is connected to the input terminal Vin. A negative electrode of the diode D5 is connected, on the one hand, to a collector of the triode Q1 and, on the other hand, to a positive electrode of the diode D6 via the resistor R3. A negative electrode of the diode D6 is connected to a base of the triode Q1. The collector of the triode Q1 is grounded via the resistor R5 and the capacitor C3 in turn. The resistor R4 is disposed between the base and an emitter of the triode Q1. The emitter of the triode Q1 is connected to the positive electrode of the primary winding Np2.

Embodiment 3

A difference from Embodiment 1 is that, the first current switch includes a diode D9 and an N-channel metal oxide semiconductor (NMOS) transistor M1. A positive electrode of the diode D9 is connected to the negative electrode of the primary main winding Np1. A negative electrode of the diode D9 is connected to a drain of the NMOS transistor M1. A gate of the NMOS transistor M1 is connected to the first drive output terminal 6 of the controller. A source of the NMOS transistor M1 is grounded via the resistor R11.

Embodiment 4

A difference from Embodiment 1 is that, the first current switch includes an NMOS transistor M1*a* and an NMOS transistor M1*b*. A drain of the NMOS transistor M1*a* is connected to the negative electrode of the primary main winding Np1. The NMOS transistor M1*a* is connected to a gate of the NMOS transistor M1*b* while being connected to the first drive output terminal 6 of the controller. A source of the NMOS transistor M1*a* is connected to a source of the NMOS transistor M1*b*. A drain of the NMOS transistor M1*b* is grounded via the resistor R11.

Embodiment 5

A difference from Embodiment 1 is that, the second current switch includes an NMOS transistor M2. A drain of the NMOS transistor M2 is connected to the negative electrode of the primary winding Np2 of the transformer and the positive electrode of the diode D12 simultaneously. A gate of the NMOS transistor M2 is connected to the second drive output terminal 5 of the controller. A source of the NMOS transistor M2 is grounded via the resistor R16.

In FIG. 2, the transformer T1 has four windings: the winding Np1 and the winding Np2 are in phase and has a turn ratio of m (m≥1, the description of the disclosure is made based on that m=1, that is, the winding Np1 and the winding Np2 have the same number); the winding Ns and the winding Na are in phase. That is, Ns/Na and Np1/Np2 are in opposite phase. The three windings Np1, Np2 and Na are applied to the primary side of the transformer, and only the winding Ns is applied to the secondary side of the transformer. The Np1 is a main winding for transferring a first phase current I*sin ωt to the secondary winding of the transformer, that is, the power supply output terminal, while transferring charge required for a second phase current I*(1−sin ωt) to the winding Np2 and storing it in the capacitor C7. The winding Na is used to monitor the next switching period of the controller after the current of the secondary winding Ns drops to zero in each switching period, that is, to ensure that the current is in critical mode. The winding Na is further used to provide supply voltage to a power supply of the chip and monitor output overvoltage simultaneously, after being started.

When the power supply is connected to an AC power supply, a voltage Vin across the capacitor C1 rises rapidly, and a start-up circuit module charges the capacitor C3 and the capacitor C7 simultaneously. The capacitor C3 is connected to the pin 3 of the chip, that is, a power pin of the controller. The capacitor C7 is used to store the charge for transmitting the second phase current. A voltage across the capacitor C7 is divided by a sense resistor R7 and the sense resistor R8, and then fed back to the pin 4 of the controller. When the controller monitors that the voltage across the capacitor C7 rises to a peak voltage equal to the input line voltage Vin divided by m (the turn ratio of Np1 to Np2, m=1) via the pin 1 and the pin 4, and simultaneously detects that a voltage across the capacitor C3 (i.e., the power supply of the controller) rises to a voltage (such as 15 V to 20 V) set by a undervoltage lock out (UVLO), the controller starts to operate, and controls the pin 6 and the pin 5 of the controller to alternately output drive signals to drive switching devices M1 and M2. Once the controller starts operating, the controller sends a control signal to the start-up circuit via the pin 2, and then the start-up circuit stops operating. After the controller starts operating, the controller collects AC input voltage information via the pin 1, combines two-phase peak current information detected by the pin 7 and the pin 9 of the chip, and then generates reference voltage waveforms of peak valued of the first phase transmission current, as shown in solid line ABJCD of FIG. 3(*a*), in a first sinusoidal half-wave cycle through a circuit operation inside the chip.

$$V_0 = V_{J0} * \sin \omega t \tag{2}$$

Where $V_{J0}$ is a voltage value at point J0 (corresponding to a peak position of the sinusoidal half-wave input voltage), which is obtained by reducing the peak value of the sinusoidal half-wave input voltage by several times. Then, by calculating $(V_{J0}-V_0)=V_{J0}*(1-\sin \omega t)$, the peak reference voltage waveform of the second phase transmission current shown by a dotted line EFGH in FIG. 3(*a*) is obtained.

$$V_2 = V_{J0} * (1-\sin \omega t) \tag{3}$$

Figure 3A:
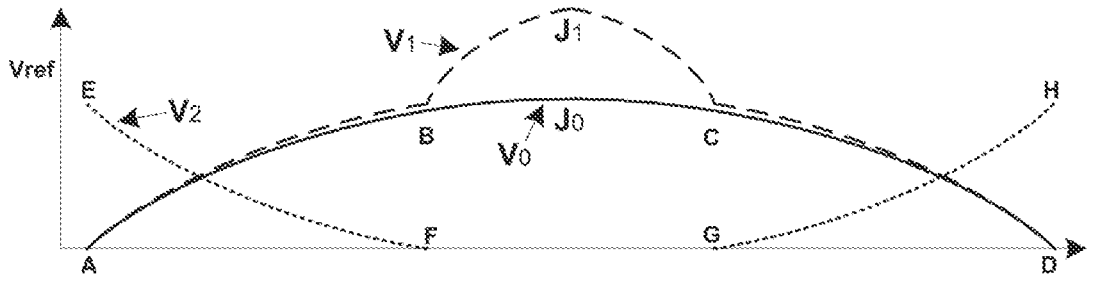
FIG. 3(*a*) is a view showing reference voltage waveforms corresponding to peak values of two-phase transmission currents after a controller is turned on in FIG. 2.
Figure 3B:
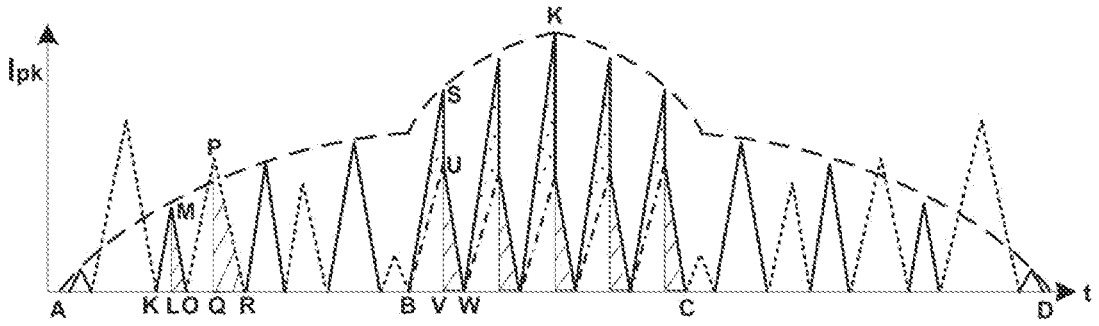

After the controller starts to operate, the controller alternately outputs the drive signals to drive the switching devices M1 and M2 in FIG. 2. The switch-on time of the two switching devices is obtained by detecting voltages $V_{R11}$ and $V_{R16}$ generated across the sense resistors R11 and R16 between the sources of M1 and M2 and the ground, respectively, of the current on the primary main winding Np1 and the primary winding Np2 of the transformer via the pin 7 and the pin 9 of the controller, respectively, and then comparing the voltages $V_{R11}$ and $V_{R16}$ with the current peak reference voltages $V_0$ and $V_2$ described above via a comparator inside the chip. As shown in FIG. 3(*b*), in the power frequency half cycle from a point A, a rising edge of a small triangle of a first solid line indicates that the current of the primary winding Np1 of the transformer rises linearly after M1 is turned on, and the switch-on time is controlled by the aforementioned comparator. After M1 is turned off, the current of the secondary winding Ns of the transformer drops linearly from its peak value, as shown by a falling edge of the small triangle of the first solid line. When the current of the secondary winding Ns drops to 0, M2 is turned on. Similarly, rising and falling edges of a large triangle of a second dotted line indicate the rising current of the primary winding Np2 and the falling current of the secondary winding Ns, respectively. Once the current of the secondary winding Ns drops to 0, the M1 and the M2 are turned on again alternately. The time point when the current of the secondary winding Ns drops to 0 is obtained by detecting the voltage across the primary winding Na of the transformer, that is, the divided voltage of the resistors R12 and R13, via the pin 8 of the chip. As can be seen from the reference voltage of the comparator shown in FIG. 3(*a*), when the M1 and the M2 are alternately turned on, the peak currents of the primary main winding Np1 and the secondary winding Ns of the transformer, that is, the first phase output current, is gradually increased, and the peak currents of the primary winding Np2 and the secondary winding Ns of the transformer, that is, the second phase output current, is gradually decreased as shown in the left side of FIG. 3(*b*).

In order to show the alternating switch-on processes of the M1 and the M2 described above more clearly, the left side of FIG. 4 shows the current waveforms of the primary and secondary windings of the transformer when the M1 and the M2 are turned on and off in two adjacent switching periods. From a time point K, the M1 is turned on, the current Ipri1 of the primary winding Np1 of the transformer rises linearly, and the voltage $V_{R11}$ generated by Ipri1 across the R11 is fed back to a positive input terminal of the comparator inside the chip via the pin 7. A negative input terminal of the comparator is connected to the internal reference voltage $V_0$ or $V_1$ shown in FIG. 3(*a*). When the M1 is turned on for the time of ton1 and $V_{R11}$ is greater than $V_0$ or $V_1$, the comparator outputs a high level and the M1 is turned off. Then, the current of the secondary winding Ns of the transformer drops linearly from its peak value. Since the turn ratio of the primly main winding Np1 and the secondary winding Ns is N, the peak current Isen_pk of the secondary winding Ns is N times the primary peak current Ipri1_pk. Therefore, Ipri1_pk=Isen_pk/N. When the current of the secondary winding drops to zero, the M2 is turned on, the current Ipri2 of the primary winding Np2 of the transformer increases linearly, and the voltage $V_{R16}$ generated by the Ipri2 across the resistor R16 is fed back to the positive input terminal of the comparator inside the chip via the pin 9 of the chip. The negative input terminal of the comparator is connected to the internal reference voltage $V_2$ shown in FIG. 3(*a*). When the M2 is turned on for the time of ton2, $V_{R16}$ is greater than $V_2$, the comparator outputs a high level and the M2 is turned off. Then, the current of the secondary winding Ns of the transformer drops linearly from its peak value. Since the turn ratio of the primary winding Np2 and the secondary winding Ns is N, the peak current Isen_pk of the secondary winding Ns is N times the primary peak current Ipri2_pk. Therefore, Ipri2_pk=Isen_pk/N. A hatched area patterned portion with solid slant lines shown in the figure is a portion that contributes to the output current.

Since there is a forward combination between the primary main winding Np1 and the primary winding Np2 of the transformer, when $V_{C7}$>Vin/m (m=1), if there is no diode D9, once the M2 is turned on, a current on the primary main winding Np1 of the transformer flows from the positive electrode of the primary main winding Np1 to the capacitor C1, that is, energy on the capacitor C7 is transferred back to the capacitor C1. However, due to the presence of the diode D9, the current on the primary winding Np1, that is, the first phase current, can only flow unidirectionally, that is, flow along a direction from the capacitor C1 to the primary main winding Np1, to the diode D9, and then to the direction M1. Therefore, when the M2 is turned on, even if $V_{C7}$>Vin, the energy on the C7 is not transferred back to the capacitor C1.

As time passes by, the energy stored in the capacitor C7 is gradually transferred to the secondary side of the transformer, that is, the output terminal, via the primary winding Np2 controlled by the switch M2. Therefore, the voltage $V_{C7}$ across the capacitor C7 gradually decreases. Meanwhile, the AC input voltage Vin gradually rises. When the time advances to a point B, that is, when $V_{C7}$<Vin/m (m=1), since there is a forward combination between the primary windings Np1 and Np2 of the transformer, one the M1 is turned on, the current on the Np1 increases, while the current on the Np2 increases simultaneously. However, such current INp2 is directed from the positive electrode of the Np2 to the C7, and then passes through the resistor R16 to the source of the M2, and then passes through a body diode of the M2 to the negative electrode of the Np2, that is, the $I_{Np2}$ charges the capacitor C7. Therefore, the voltage generated by the $I_{Np2}$ across the resistor R16 is negative. When the pin 9 of the controller detects that the voltage across the R16 is less than zero, the pin 5 of the chip also outputs the drive signal, and the M2 is turned on, so that the $I_{Np2}$ flows through the M2 and no longer flows through the body diode of the M2. In this case, M2 plays a role of synchronous rectification to reduce power consumption and improve efficiency. The M2 is turned off at the same time as the M1 is turned off. After the M1 is turned off, the peak current Isen_pk/N of the secondary winding Ns of the transformer no longer coincides with the peak current of the primary main winding Np1 at a point S, but drops from a point U. This is because the energy on the primary main winding Np1 of the transformer is transferred to the secondary winding Ns and also to the primary winding Np2 when the M1 is turned on, thereby charging the capacitor C7. In this case, when the current Isen of the secondary winding Ns drops to zero, the M1 is turned on again instead of M2. Since additional energy is required to charge the capacitor C7, from a time point B, the reference voltage corresponding to the peak value of the current of the primary main winding Np1 when M1 is turned on needs to be increased. The amplitude of the increase is determined according to a difference between Vin and $V_{C7}$ detected by the pin 1 and the pin 4 of the chip. Therefore, starting from the second sinusoidal half-wave of the input voltage, a schematic view showing the reference voltage waveform of the first phase peak current is shown by a broken line $ABJ_1CD$ in FIG. 3(*a*), and which is different from that in a time interval AB segment that, from the time point B to a time point C, since the capacitor C7 needs to be charged, the second phase current controls the switch M2 not to be turned on and to always be in the off state, and only the first phase current controls the switch M1 to be turned on and off.

Figure 4:
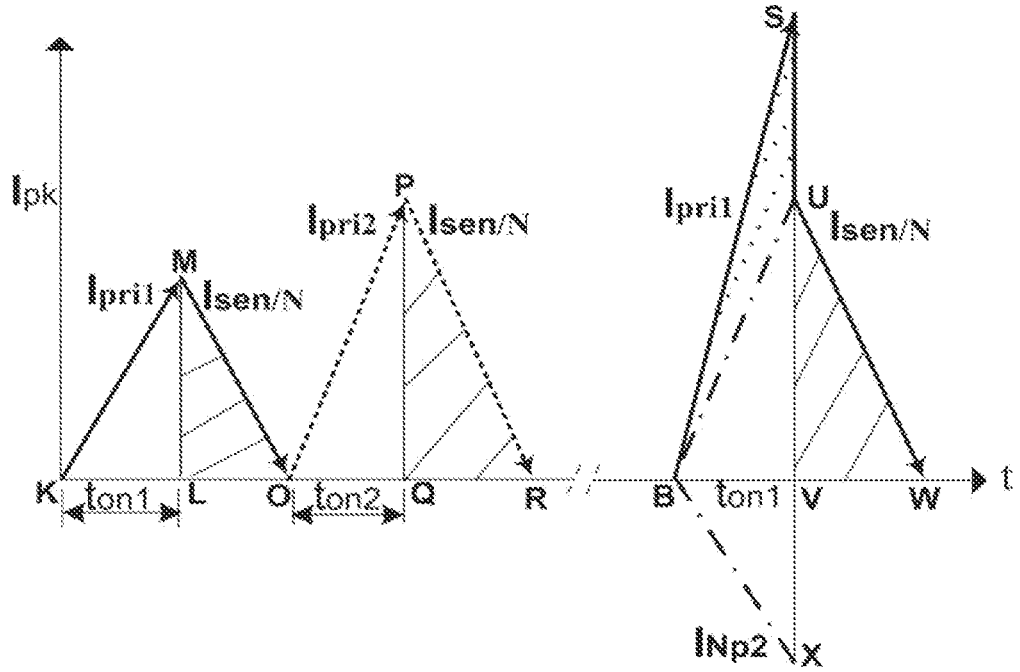
FIG. 4 is a partial enlarged schematic view of FIG. 3(*b*).

In order to show the switch-on and switch-off processes of the M1 during a time period in which the capacitor C7 needs to be charged ($V_{C7}$<Vin) more clearly, the current waveforms of the primary and secondary windings of the transformer when the M1 is turned on and off during one switching period are shown in the right side of FIG. 4. From the time point B, M1 is turned on. Due to $V_{C7}$<Vin, the current Ipri1 of the primary main winding Np1 of the transformer rises linearly at a relatively fast rate, and the rising rate is related not only to the inductance of the primary winding of the transformer and the magnitude of Vin, but also to a difference of (Vin−$V_{C7}$). The larger the difference of (Vin−$V_{C7}$) is, the faster the Ipri1 rises. The rapid rise of the Ipri1 is caused by a coupling induced current on the second phase primary winding Np2, that is, the charging current $I_{Np2}$ to the capacitor C7. A direction of the $I_{Np2}$ is opposite to a direction of Ipri1, that is, the $I_{Np2}$ is negative. Therefore, the voltage $V_{R16}$ generated by the $I_{Np2}$ across the resistor R16 is a negative voltage. Similarly, the voltage $V_{R11}$ generated by Ipri1 across resistor R11 is fed back to the positive input terminal of the comparator inside the chip via the pin 7 of the chip. The negative input terminal of the comparator is connected to the internal reference voltage $V_1$ shown in FIG. 3. When the M1 is turned on for a time of ton1 and VR11 is greater than V1, the comparator outputs a high level and the M1 is turned off. Due to the presence of $I_{Np2}$, only a part of Ipri1 is used to be stored and transferred to the secondary side of the transformer. That is, at the time point S, after the peak value of the Ipri1 subtracts the absolute value of the peak value of the $I_{Np2}$, the Ipri1_U corresponding to the point U is the peak value of the current of the primary winding Np1 inductively coupled to the secondary winding. A height of the SU in FIG. 4 is equal to a height of VX, and an area of a triangle SBU is equal to an area of a triangle XBV. After the M1 is turned off, the current of the secondary winding Ns of the transformer falls linearly from its peak value. At this time, the peak current of the secondary winding Ns is Isen_pk=N*Ipri1$_{_U}$. The hatched area patterned portion with the solid slant lines in FIG. 4 is the portion that contributes to the output current.

When the time is advanced to the point C, the controller detects that the voltage $V_{C7}$ across the capacitor C7 is equal to the Vin, M2 starts to be turned on and off again. As in the time interval AB segment, in a time interval CD segment, the M1 and the M2 are alternately turned on and off, except that the first phase peak current gradually decreases and the second phase peak current gradually increases. Thereafter, the time advances to the next sinusoidal half-wave cycle, since the comparison reference voltage waveform of the first phase peak current changes from $V_0$ (shown in a curve $ABJ_0CD$) to $V_1$ (shown in a curve $ABJ_1CD$), the maximum value of the second phase peak current comparison reference voltage is obtained from the average value of the first phase reference voltages at time points B and C, that is, $$V_{BC}=(V_{1(B)}+V1_{(C)})/2 \tag{4}$$

Thus, from the second sinusoidal half-wave cycle of the input voltage, the second phase peak current comparison reference voltage may be expressed as:

$$V_2=V_{BC}-V_1 \tag{5}$$

Since in a time period BC, $V_{BC}<V_1$, that is, $V_2<0$. Therefore, the portion of $V_2<0$ is processed as V2=0, that is, which is an FG segment of the waveform of $V_2$. From the above analysis, it can be learned that, in the current transmission process of the present disclosure, due to the superposition of the two-phase complementary currents, the fluctuation of the output current is significantly reduced. Such effect can also be seen from the peak values of the primary effective current and secondary effective current of the transformer of FIG. 3(*b*). The total output current can be obtained by cumulatively calculating the triangular area of the falling portion of the current of the secondary winding in each switching period, and then dividing it by the time of the sinusoidal half-wave cycle from A to D, that is, a half of the AC input power frequency cycle.

Figure 5A:
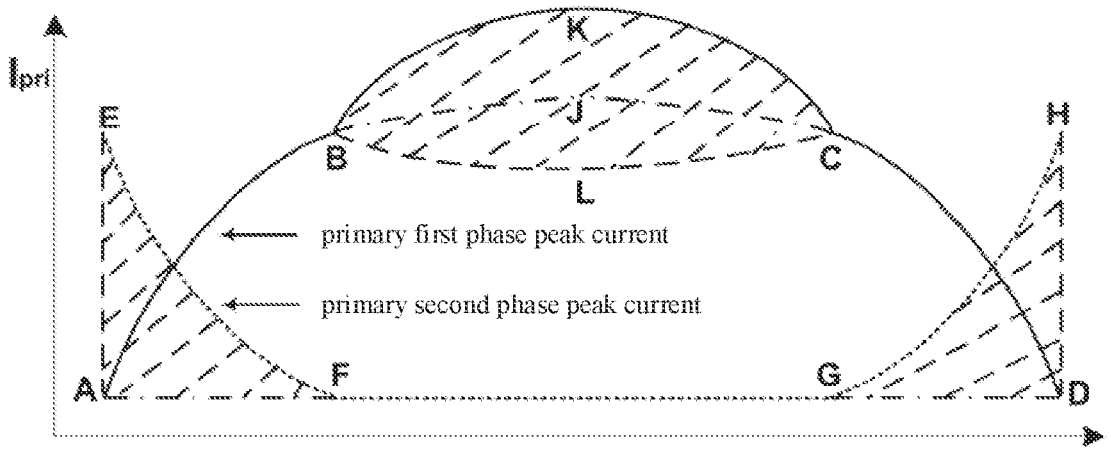
FIG. 5(*a*) is a schematic view of peak currents of two-phase transmission currents of a primary side of a transformer in a half power frequency cycle after the controller is turned on in FIG. 2.
Figure 5B:
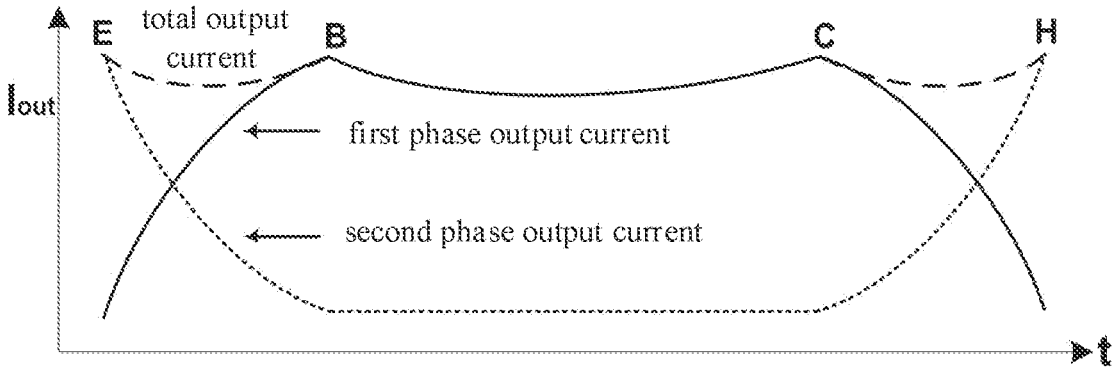

In order to express the principles and effects of the present disclosure more intuitively, the present disclosure will be further explained below. As shown in FIG. 5(*a*), in a conventional single-stage high power factor LED lighting drive power supply, the current transmission has only one phase, and in the sinusoidal half-wave cycle after the AC input full-bridge rectification, the peak curve of the current transmission is ABJCD. While the current transmission of the present disclosure has two phases, the peak curve of the first phase transmission current is ABKCD, but the peak curve of the first phase transmission current which directly contributes to the output current is ABLCD. The peak curve of the second phase transmission current is EFGH. The control method of the present disclosure stores the product of the current and the time of the dotted line hatched portion surrounded by BKCL, that is, the charge, in the dotted line hatched region surrounded by AEF and GHD as the charge of the second phase transmission current, when the first phase current transmission is performed. During time periods AF and GD, the M1 and the M2 are alternately turned on and off. During a time period FG, that is, a time period BC, only the M1 is turned on and off. Therefore, as shown in FIG. 5(*b*), a waveform curve of the total output current after the two-phase output currents are superimposed is EBCH. The power factor is greater than 0.92 and the total output current ripple is less than 6%(+/−3%) by optimizing the differences between the current at the point K and the current at the point J and between the current at the point J and the current at the point L in FIG. 5(*a*). Compared with the waveform curve ABJCD of the output current of the conventional single-stage high power factor drive power supply shown in FIG. 1(*b*), the ripple of the output current of the LED lighting drive power supply of the present disclosure is significantly reduced, so that the LED lighting drive power supply simultaneously has the advantages of high power factor, no strobe, low cost and the like.

FIG. 6 shows a specific circuit of the start-up circuit module of FIG. 2. As shown in FIG. 6, when the AC input voltage is connected, since a capacitance value of the capacitor C1 is small (for example, 100 nF), the voltage waveform of Vin is a sinusoidal half-wave after full-bridge rectification. Initially, the voltages across capacitor C3 and the capacitor C7 are zero, thus, once the Vin increases, the diode D5 is forward biased. Before the controller starts operating, the pin 2 is in an open circuit state, that is, there is no pull-down current. The divided voltage of the resistor R3 and the resistor R4 turns on the triode Q1 and charges the capacitor C7. At the same time, the current flows from the Vin to the capacitor C3 via the diode D5 and the resistor R5, thereby charging the capacitor C3. Once the controller detects that the voltage across the capacitor C7 is equal to the peak voltage of the Vin via the pin 1 and the pin 4, the pin 2 of the controller outputs a pull-down current so that the base-emitter of the triode Q1 is in a zero voltage bias state. That is, the triode Q1 is turned off, and the charging of the capacitor C7 is stopped. Since the capacitance value (e.g., 100 μF) of the capacitor C7 is much larger than the capacitance value (e.g., 20 μF) of the capacitor C3, and it is necessary to ensure that the capacitor C7 has been charged to the peak voltage of the Vin before the capacitor C3 is charged to the start-up operating voltage (e.g., 15 V) of the chip. Therefore, a resistance value of the resistance R5 needs to be set to be relatively large (for example, 300 KΩ). The function of the diode D5 is to ensure that the current does not flow backward when the input voltage Vin is lower than the voltages across the capacitors C3 and C7. The function of the diode D6 is to ensure that the charge on the capacitor C7 does not flow through the resistor R4 to the pin 2 of the chip. In FIG. 7, the diode D9 shown in FIG. 6 is removed, and the switch metal-oxide-semiconductor filed effect (MOSFET) M1 shown in FIG. 6 is replaced with two MOSFETs M1*a* and M1*b*. Since sources of the M1*a* and the M1*b* are connected together, that is, anodes of body diodes thereof are connected together. Thus, moving the diode D9 in FIG. 6 to a position of the M1*b* can also function as preventing the current of the primary main winding Np1 of the transformer from flowing backward when the M2 is turned on and $V_{C7}$>Vin. Moreover, it is advantageous that when the M1*a* and the M1*b* are turned on, a voltage drop of the M1*b* is smaller than a forward voltage drop of the diode D9, so that the power consumption can be appropriately reduced and the conversion efficiency can be improved.

What is claimed is:

1. A drive circuit for high power factor stroboscopic-free LED lighting, comprising;

a start-up circuit, a controller, a transformer (T1), a first current switch and a second current switch;

wherein the transformer (T1) comprises a primary main winding (Np1), a second primary winding (Np2), a third primary winding (Na) and a secondary winding (Ns);

wherein the primary main winding (Np1) and the second primary winding (Np2) are in phase, the third primary winding (Na) and the secondary winding (Ns) are in phase, the primary main winding (Np1) and the secondary winding (Ns) are in opposite phase;

wherein the start-up circuit and the transformer (T1) are connected to an input terminal (Vin);

wherein the start-up circuit, the first current switch, and the second current switch are connected to the controller; and wherein the controller controls current output of the secondary winding (Ns) of the transformer T1) by controlling switch-on and switch-off of the first current switch, and the second current switch;

wherein the drive power supply circuit further comprises a first capacitor (C1), a second capacitor (C2), a third capacitor (C3), a fourth capacitor (C4), a fifth capacitor (C5), a sixth capacitor (C6), a seventh capacitor (C7), an eighth capacitor (C8) and a ninth capacitor (C9); a first resistor (R1), a second resistor (R2), a sixth resistor (R6), a seventh resistor (R7), an eighth resistor (R8), a ninth resistor (R9), an eleventh resistor (R11), a twelfth resistor (R12), a thirteenth resistor (R13), a fifteenth resistor (R15), a sixteenth resistor (R16) and a seventeenth resistor (R17); a seventh diode (D7) and an eighth diode (D8), a twelfth diode (D12) and a thirteenth diode (D13);

wherein an input voltage monitoring input terminal 1 of the controller is grounded via the second resistor (R2); the second capacitor (C2) is arranged in parallel at both ends of the second resistor (R2); an input terminal (Vin) is connected to the input voltage monitoring input terminal (1) of the controller via the first resistor (R1); the first capacitor (C1) is disposed between the input terminal (Vin) and ground; a high voltage input terminal (a) of the start-up circuit is connected to the input terminal (Vin); a feedback input terminal (d) of the start-up circuit is connected to a precharge completion feedback output terminal (2) of the controller; a precharge output terminal (c) of the start-up circuit is connected to one end of the third capacitor (C3), and the other end of the third capacitor (C3) is grounded; a precharge output terminal (b) of the start-up circuit is connected to the seventh resistor (R7) and an energy storage seventh capacitor (C7) simultaneously, and is grounded via the seventh resistor (R7) and the eighth resistor (R8) in turn; an intersection point of the seventh resistor (R7) and the eighth resistor (R8) is connected to a voltage monitoring input terminal (4) of the controller for the seventh capacitor (C7); a first phase transmission current monitoring input terminal (7) of the controller is connected to a current output terminal of a first control switch via the ninth resistor (R9); a second phase transmission current monitoring input terminal (9) of the controller is connected to a current output terminal of a second control switch via the fifteenth resistor (R15); a transformer secondary current and output overvoltage monitoring input terminal (8) of the controller is grounded via the thirteenth resistor (R13), and connected to an anode of the eighth diode (D8) via the twelfth resistor (R12); and wherein a positive electrode of the primary main winding (Np1) is connected to the input terminal (Vin), a negative electrode of the primary main winding (Np1) is returned to the positive electrode via the seventh diode (D7) and the sixth resistor (R6) in turn, to form a closed circuit the fourth capacitor (C4) is connected in parallel at both ends of the sixth resistor (R6); a positive electrode of the seventh diode (D7) is grounded via the first current switch and the eleventh resistor (R11) in turn; a control terminal of the first current switch is connected to a first drive output terminal (6) of the controller; a negative electrode of the seventh diode (D7) is connected to a negative electrode of the twelfth diode (D12), a positive electrode of the twelfth diode (D12) is grounded via the second current switch and the sixteenth resistor (R16) in turn; a control terminal of the second current switch is connected to a second drive output terminal (5) of the controller;

a positive electrode of the third primary winding (Na) is grounded, a negative electrode of the third primary winding (Na) is connected to the twelfth resistor (R12) and connected to the precharge output terminal (c) of the start-up circuit and a power supply input terminal (3) of the controller simultaneously via the eighth diode (D8); a positive electrode of the second primary winding (Np2) is connected to the precharge output terminal (b) of the start-up circuit, and is returned to a negative electrode of the second primary winding (Np2) via the seventh capacitor (C7), the sixteenth resistor (R16), and the second current switch in turn simultaneously, to form a circuit and both ends of the secondary winding (Ns) pass through the thirteenth diode (D13) to a power output terminal and are connected to a LED lights.

2. The drive circuit for high power factor stroboscopic-free LED lighting according to claim 1, wherein the energy storage seventh capacitor (C7) is configured to store energy required by the second phase transmission current.

3. The drive circuit for high power factor stroboscopic-free LED lighting according to claim 1, wherein the start-up circuit comprises a first triode (Q1), a fifth diode (D5) and a sixth diode (D6), and a third resistor (R3), a fourth resistor (R4) and a fifth resistor (R5); a positive electrode of the fifth diode (D5) is connected to the input terminal (Vin); a negative electrode of the fifth diode (D5) is connected, on the one hand, to a collector of the first triode (Q1) and, on the other hand, to a positive electrode of the sixth diode (D6) via the third resistor (R3); a negative electrode of the sixth diode (D6) is connected to a base of the first triode (Q1); the collector of the first triode (Q1) is grounded via the fifth resistor (R5) and the third capacitor (C3) in turn; the fourth resistor (R4) is disposed between the base and an emitter of the first triode (Q1); and the emitter of the first triode (Q1) is connected to the positive electrode of the second primary winding (Np2).

4. The drive circuit for high power factor stroboscopic-free LED lighting according to claim 1, wherein the first current switch comprises a ninth diode (D9) and an N-channel metal oxide semiconductor transistor (M1); a positive electrode of the ninth diode (D9) is connected to the negative electrode of the primary main winding (Np1); a negative electrode of the ninth diode (D9) is connected to a drain of the N-channel metal oxide semiconductor transistor (M1), a gate of the N-channel metal oxide semiconductor transistor (M1) is connected to the first drive output terminal (6) of the controller, a source of the N-channel metal oxide semiconductor transistor (M1) is grounded via the eleventh resistor (R11).

5. The drive circuit for high power factor stroboscopic-free LED lighting according to claim 1, wherein the first current switch comprises an N-channel metal oxide semiconductor transistor (M1*a*) and an N-channel metal oxide semiconductor transistor (M1*b*); a drain of the N-channel metal oxide semiconductor transistor (M1*a*) is connected to the negative electrode of the primary main winding (Np1); a gate of the N-channel metal oxide semiconductor transistor (M1*a*) is connected to a gate of the N-channel metal oxide semiconductor transistor (M1*b*) while being connected to the first drive output terminal (6) of the controller, a source of the N-channel metal oxide semiconductor transistor (M1*a*) is connected to a source of the N-channel metal oxide semiconductor transistor (M1*b*), a drain of the N-channel metal oxide semiconductor transistor (M1*b*) is grounded via the eleventh resistor (R11).

6. The drive circuit for high power factor stroboscopic-free LED lighting according to claim 1, wherein the second current switch comprises an N-channel metal oxide semiconductor transistor (M2); a drain of the N-channel metal oxide semiconductor transistor (M2) is connected to the negative electrode of the second primary winding (Np2) of the transformer and the positive electrode of the twelfth diode (D12) simultaneously; a gate of the N-channel metal oxide semiconductor transistor (M2) is connected to the second drive output terminal (5) of the controller; and a source of the N-channel metal oxide semiconductor transistor (M2) is grounded via the sixteenth resistor (R16).

* * * * *